United States Patent [19]

Newton

[11] 4,028,747

[45] June 14, 1977

[54] OIL TOILET

[75] Inventor: Leroy Newton, Marina Del Rey, Calif.

[73] Assignee: Monogram Industries, Inc., Los Angeles, Calif.

[22] Filed: Mar. 26, 1976

[21] Appl. No.: 670,990

[52] U.S. Cl. ..... 4/10; 4/76; 4/77; 4/DIG. 11

[51] Int. Cl.[2] ..... E03D 1/00; E03D 3/00; E03D 5/00

[58] Field of Search ..... 4/10, DIG. 11, 76, 73, 4/75, 1, 68

[56] References Cited

UNITED STATES PATENTS

| | | | |
|---|---|---|---|
| 2,778,029 | 1/1957 | Young | 4/75 |
| 3,032,776 | 5/1962 | O'Bart et al. | 4/131 |
| 3,262,132 | 7/1966 | Mann | 4/75 |
| 3,431,563 | 3/1969 | Rascov | 4/DIG. 11 |
| 3,829,909 | 8/1974 | Rod | 4/10 |
| 3,922,730 | 12/1975 | Kemper | 4/10 |
| 3,934,275 | 1/1976 | Bishton, Jr. | 4/10 |
| 3,974,528 | 8/1976 | Claunch et al. | 4/10 |

FOREIGN PATENTS OR APPLICATIONS

| | | | |
|---|---|---|---|
| 11,775 | 10/1902 | Sweden | 4/75 |
| 10,222 | 3/1895 | Switzerland | 4/75 |
| 23,404 | 12/1893 | United Kingdom | 4/75 |

*Primary Examiner*—Henry K. Artis
*Attorney, Agent, or Firm*—Poms, Smith, Lande & Glenny

[57] ABSTRACT

An improved oil toilet for use with an oil-based flushing fluid including a commode having a bowl portion of the wash-down type having a generally concave inner surface and a flushing manifold at the top thereof. The inner surface is in fluid communication with a trapway having a trap seal therein leading to a discharge outlet. Overflow means are provided intergral with the inner surface for returning overflow from the bowl portion back into the dishcarge outlet. A trap seal is associated with the overflow means for sealing off odors from the discharge outlet. Fluid communication is provided between the trap seal in the overflow means and the manifold for replenishing the oil in the trap of the trap seal in the overflow means.

11 Claims, 3 Drawing Figures

OIL TOILET

BACKGROUND OF THE INVENTION

1. Field of the Invention

The invention relates to oil toilets, and more particularly, to a commode for use in an oil toilet having improved flushing action.

2. Description of the Prior Art

In conventional toilet or sanitation systems, commodes or toilet bowls are typically syphon-type bowls. That is, these commodes have a syphon jet associated therewith which creates a syphon action in the outlet passageway and there is actually a slight negative pressure or suction created. Such syphon-type bowls are slow flushing and inclined to clog very easily. If such bowls do clog, overflow may take place and wastewater will be dumped onto the floor or other location where the bowl is installed.

Heretofore, such overflow, although messy and unaesthetically pleasing, was not particularly dangerous. However, in recent years, more and more attention has been directed to toilet systems which do not use water as a flushing medium. Such toilet systems are generally of the recirculating type and utilize an oil-based flushing fluid, such as mineral oil, as the flushing medium. This oil is generally returned to the waste tank along with the waste after flushing and recirculated back into the bowl or commode when required. Such systems are exemplified in U.S. Pat. No. 3,673,614 to Claunch and U.S. Pat. No. 3,829,909 to Rod et al.

The bowls or commodes used in such systems have generally been of the aforementioned syphon-type. However, if clogging takes place in the bowls or commodes of these systems, oil, instead of wastewater, will be dumped onto the floor or the like in the area in which the commode or bowl is installed. Oil is extremely slippery and thus it is dangerous to have such oil on the floor or the like. The bowls or commodes of such systems may be installed in areas of high traffic or on public conveyances increasing the exposure to danger. Finally, oil can cause permanent damage to the area in which it is spilled.

In view of the foregoing, efforts were made by the applicant to discover a more efficient bowl or commode for use in an oil toilet system than the known types. Applicant was aware of a prior art water-flush bowl or commode manufactured and sold in Greece by Kerafina Co. (hereinafter referred to as "Kerafina" bowl) that was of the wash-down type wherein a volume of water coming into the bowl washes everything down and out of the trap of the bowl. However, such bowl is illegal for use in water flush toilets in the United States since it has a very small trap seal height which is not acceptable in American Standards as set forth in the Uniform Building Plumbing Code. Insofar as applicant or assignee knows, such wash-down toilet is not available in the United States.

Applicant is aware of the following U.S. Pat. Nos. relating to an overflow associated with a toilet bowl: 397,781; 474,682; 620,352; 1,110,831; 1,167,738; 1,171,694; 1,180,171; 1,205,078; 1,224,974; 1,313,060; 1,430,417; 1,692,368; 2,778,029; 3,262,132; and 3,302,216. However, these bowls are all legal for use in water flush system in the U.S. where a bowl of the Kerafina type is illegal in the U.S.

SUMMARY OF THE INVENTION

It is an object of the invention to provide an improved oil toilet.

It is a further object of this invention to provide a gravity flush oil toilet capable of flushing a large quantity of fluid without clogging.

It is a still further object of this invention to provide a gravity flush commode for use in an oil toilet system that provides for overflow protection should such toilet clog during use.

These and other objects are preferably accomplished by providing a commode having a bowl portion of the wash-down type having a generally concave inner surfaces and a flushing manifold at the top thereof. The inner surface is in fluid communication with a trapway having a trap seal therein leading to a discharge outlet. Overflow means are provided integral with the inner surface for returning overflow from the bowl portion back into the discharge outlet. A trap seal is associated with the overflow means for sealing off odors from the discharge outlet. Fluid communication is provided between the trap seal in the overflow means and the manifold for replenishing the oil in the trap of the trap seal in the overflow means.

DESCRIPTION OF THE PREFERRED EMBODIMENTS

Figure 1:
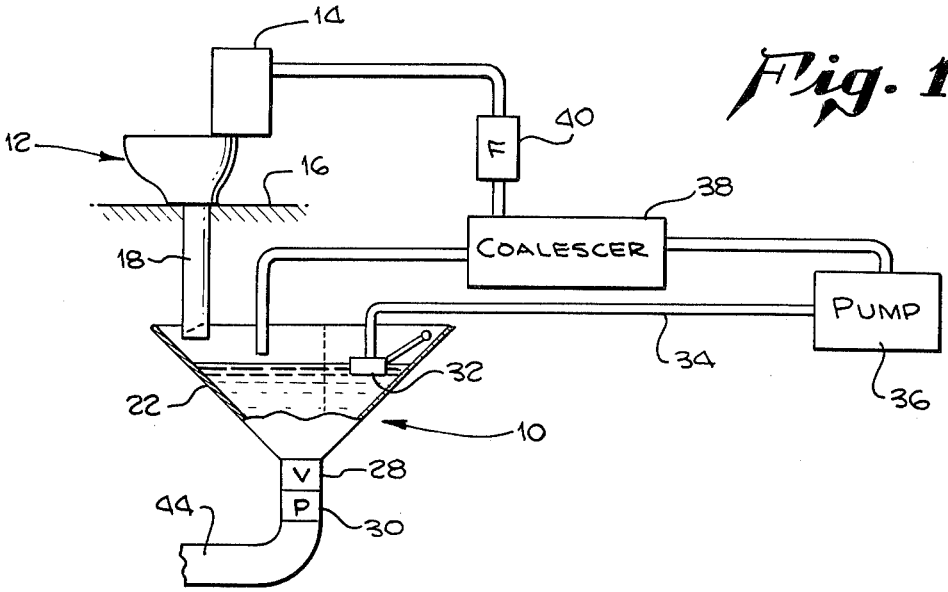
FIG. 1 is a diagrammatic view of a recirculating oil flush toilet system accordance with the invention.

Referring now to FIG. 1 of the drawing, a recirculating toilet system 10, similar to that described and claimed in U.S. Pat. No. 3,829,909 to Rod et al. is shown. Briefly, system 10 includes a toilet bowl or commode 12 with an attached toilet tank 14 mounted to a floor structure 16. A waste pipe or discharge oulet 18 connects bowl 12 to separating tank 22. Normally, flushing fluid is stored in tank 14 with an additional quantity of fluid standing in bowl 12 supported by the trap therein (as will be discussed) for creating an odor seal between bowl 12 and tank 22. Tank 14 may include conventional filling mechanism, such as a float-operated valve or ball cock which, when tank 14 is empty, admits flushing fluid. When fluid in tank 14 rises above a predetermined level, the float closes the valve to further fluid.

Tank 22 may include a dump or drain valve 28 coupled to a macerator-pump 30 leading to a waste line 44. An intake float 32 may be pivotally mounted with a flexible coupling 33 to the edge of tank 22 provided with a plurality of intake orifices for withdrawing an oil-based flushing fluid, such as mineral oil which is of a lower specific gravity than the waste in tank 22 and thus floats on the top thereof, from just below the upper surface.

An intake line 34 goes from float 32 to a pump 36, the output of which is applied to a coalescer 38 then to a filter 40. Any water products collected in coalescer 38 may be returned to tank 22 through a drain line 42. The output of filter 40 is applied to toilet tank 14 through the ball cock valve thereof.

The foregoing has briefly described a system similar to the toilet system described and claimed in U.S. Pat. No. 3,829,909. Reference should be made thereto for a complete understanding of the various features and operation of this system. Further, as will be discussed, the bowl or commode (used interchangeably) of the instant invention is applicable to any recirculating toilet system wherein oil is used as the flushing medium. For example, the recirculating toilet system described and claimed in the commonly assigned copending application Ser. No. 446,294 to Bishton et al. entitled "Sewerless Recirculating Toilet and Human Waste Storage System" utilizes a bowl or commode which can be replaced by the bowl of the instant invention. Also, toilet tank 14 may be eliminated and the flushing fluid filtered and recirculated directly back into bowl or commode 12, as for example, in the system disclosed in U.S. Pat. No. 3,934,275, also commonly assigned.

Finally, any oil-based flushing fluid suitable for use in a recirculating toilet system, such as the fluids disclosed in U.S. Pat. No. 3,673,614, may be used.

Figure 2:
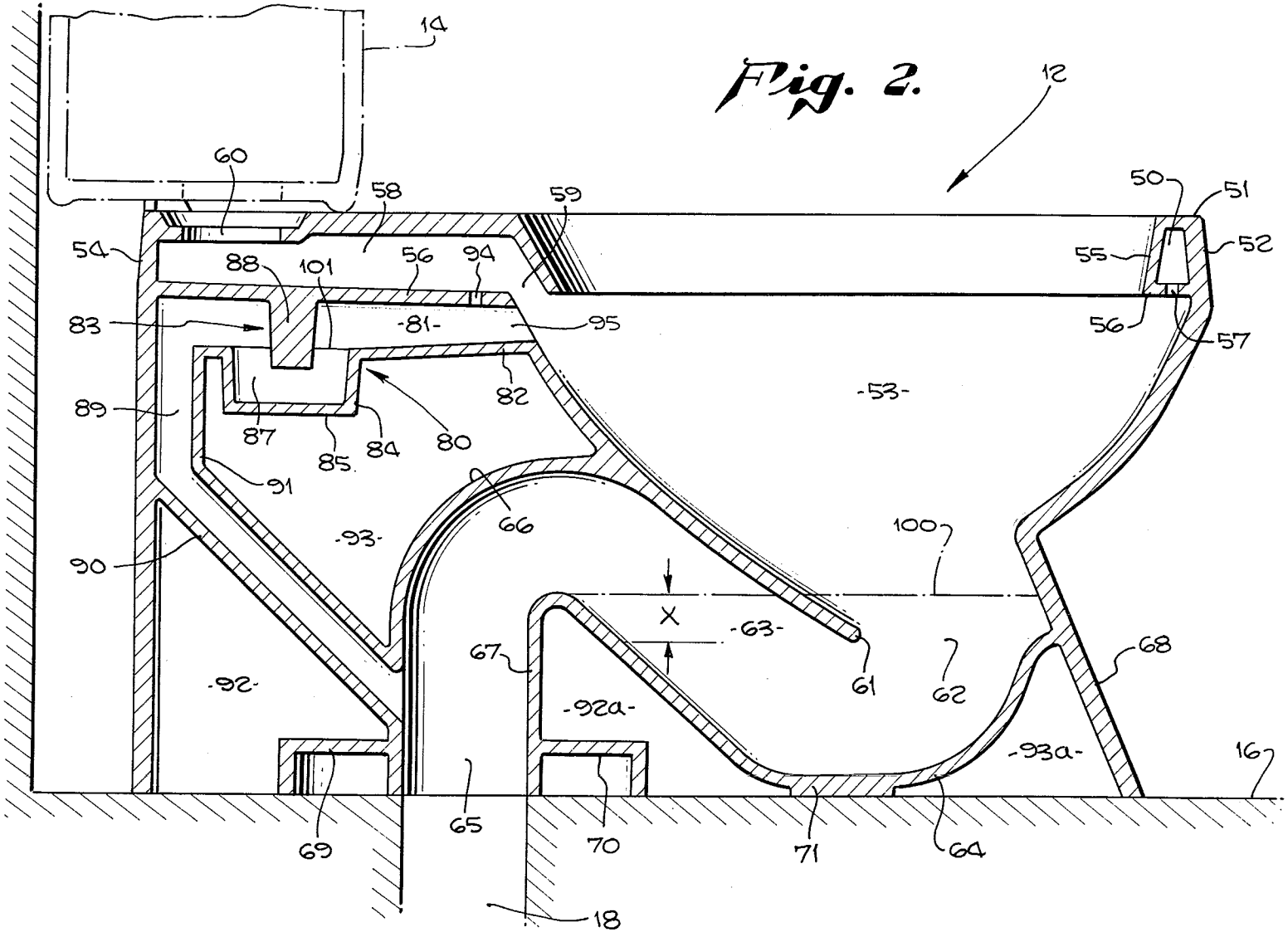
FIG. 2 is a cross-sectional view of the bowl alone of the system of FIG. 1.

Thus, referring now more particularly to FIG. 2, bowl 12 may include an inlet passageway or flushing manifold 50 about the upper periphery thereof. This manifold 50 is formed by a closed peripheral top wall 51 having an internal side wall 52 formed by the outer wall of the front or bowl portion 53 of bowl 12 and the back or rear wall 54 (wall 52 merging into wall 54 as is well known in the art). Manifold 50 is further formed by an inner peripheral wall 55 (which may slope inwardly as shown), walls 52 and 55 being closed at the bottom by a bottom wall 56. The portion of bottom wall 56 (narrow adjacent the front or side accessible to the user) may include apertures 57 therein for permitting flushing fluid introduced into manifold 50 to enter bowl portion 53. The portion of bottom wall 56 adjacent the rear wall side of bowl 12 may be wider than at the front resulting in a relatively wide manifold portion 58. Flushing fluid from manifold portion 58 exists out onto bowl portion 52 out of the aperture or opening 59 between inner wall 55 and the upper portion of bowl portion 53 adjacent the rear wall 54. It is to be understood that bowl portion 53 and the various wall portions recited are continuous and form a conventional commode or bowl as is well known in the art. Further, manifold 50 may be of any suitable design and in fluid communication with flushing fluid tank 14 via an aperture or opening 60. Thus, the dimensions of manifold 50 are not critical except insofar as to be discussed hereinbelow.

It can be seen in FIG. 2 that the inner portion of bowl portion 53 adjacent rear wall 54 terminates at an end or point 61 forming an opening 62 at the bottom of bowl portion 53. This opening 62 is in fluid communication with a trapway 63 of a relatively wide diameter, such as 3 inch or so, formed by bowl portion 53 and bottom wall 64 which extends from the front of the lower end of bowl portion 53 to a discharge outlet 65. Bottom wall 64 may merge into bowl portion 53 forming a trapway 63 generally cylindrical in cross-section. Discharge outlet 65 is formed by an upper wall 66 which extends from the floor or surface 16 (FIG. 1) up and curving over to merge into bowl portion 53 (terminating at end or point 61). Discharge outlet 65 is further formed by a wall portion 67 which extends from floor 16 up, over and down to merge into bottom wall 64. Wall portion 67 also may merge into wall portion 66 to form a generally cylindrical outlet 65 of a relatively wide diameter, such as 3 inch or so. Front support legs 68 may be provided merging into the outer wall of bowl portion 53. Supporting legs or brackets 69, 70 may be provided on wall portions 66, 67 to support bowl 12 on floor 16. Also, bottom wall 64 may be reinforced at reinforcement 71 for supporting bowl on floor 16.

It can be seen that back wall 54, supporting legs 68 through 70, reinforcement 71 and the lower portions of wall portions 66, 67 all serve to support bowl 12 in a fixed, level position on a supporting surface, such as floor 16.

It is to be understood that outlet 65 is coupled to waste line 18 of FIG. 1. The foregoing has described in detail portions of bowl 12 essentially similar to the aforementioned Kerafina bowl. However, in addition to being illegal when used in a water-flush toilet, clogging could still take place in a toilet such as the Kerafina toilet.

Thus, as particularly contemplated in the present invention, overflow preventing means 80 are provided for preventing overflow of a mixture of flushing fluid and waste out of bowl 12 and onto floor 16. In the exemplary embodiment of the invention, overflow preventing means 80 includes an overflow passageway 81, extending generally parallel to the portion 58 of flushing manifold 50 in fluid communication with flushing tank 14. Passageway 81 opens into the upper portion of bowl portion 53, directly below inner wall 55 and opening 59 from manifold 50. Passageway 81 thus may have its upper wall integral with, or the common wall of, the bottom wall 56 as shown in FIG. 2. The wall 82 forming the bottom wall of passageway 81 may be inclined slightly from the point of entry from bowl portion 53 rearwardly and downwardly toward rear wall 54. Passageway 81 may be of any suitable cross-section and thus may be rectangular having integral side walls or generally cylindrical with wall 56 merging into wall 82. Trap seal means are provided in passageway 81 including a trap seal 83 formed by a first downwardly extending side wall portion 84 from bottom wall 82 merging into a generally horizontally extending bottom wall portion 85 which merges into a second upwardly extending side wall portion 86 merging into bottom wall 82 thus forming a chamber or trap 87. The upper wall (i.e., wall 56) of passageway 81 includes an downwardly extending portion 88 of a substantial width extending downwardly into chamber or trap 87 a substantial distance below the upper surface of bottom wall 82 (e.g., ½ inch or so) at generally the midpoint of trap 87. As will be discussed, this forms a trapway for creating a trap seal.

Wall portion 86 at its upper end and as discussed merges back into bottom wall 82. The rear end of passageway 81 communicates with an overflow return passageway 89 extending at the top from passageway 81 downwardly back into outlet 65. Passageway 89 is formed by an upper portion of rear or back wall 54 which merges into a rear wall 90 which is inclined downwardly and merges into wall 66 of outlet 65. Wall portion 82 merges into a downwardly extending wall portion 91 which extends first generally parallel to back wall 54, then generally parallel to rear wall 90 to merge into wall portion 66. Passageway 89 may also be of any suitable configuration, such as rectangular, or, generally cylindrical in cross-section with rear wall 90 merging into wall portion 91.

The spaces **92, 93, 92*a*, 93*a*, formed in bowl 12 by the foregoing structure reduce the overall weight of bowl 12. Finally, overflow preventing means 80, in the exemplary embodiment, includes means for replenishing the oil-based flushing fluid in trap 87. Such means includes an aperture 94 in wall 56 between trap 87 and opening 95 leading into passageway 81. Thus, a small portion of oil from flushing fluid tank 14 in manifold portion 58 enters aperture 94 into passageway 81 for replenishing the oil in trap 87. This ensures that trap 87** always has a quantity of fresh oil therein.

Figure 3:
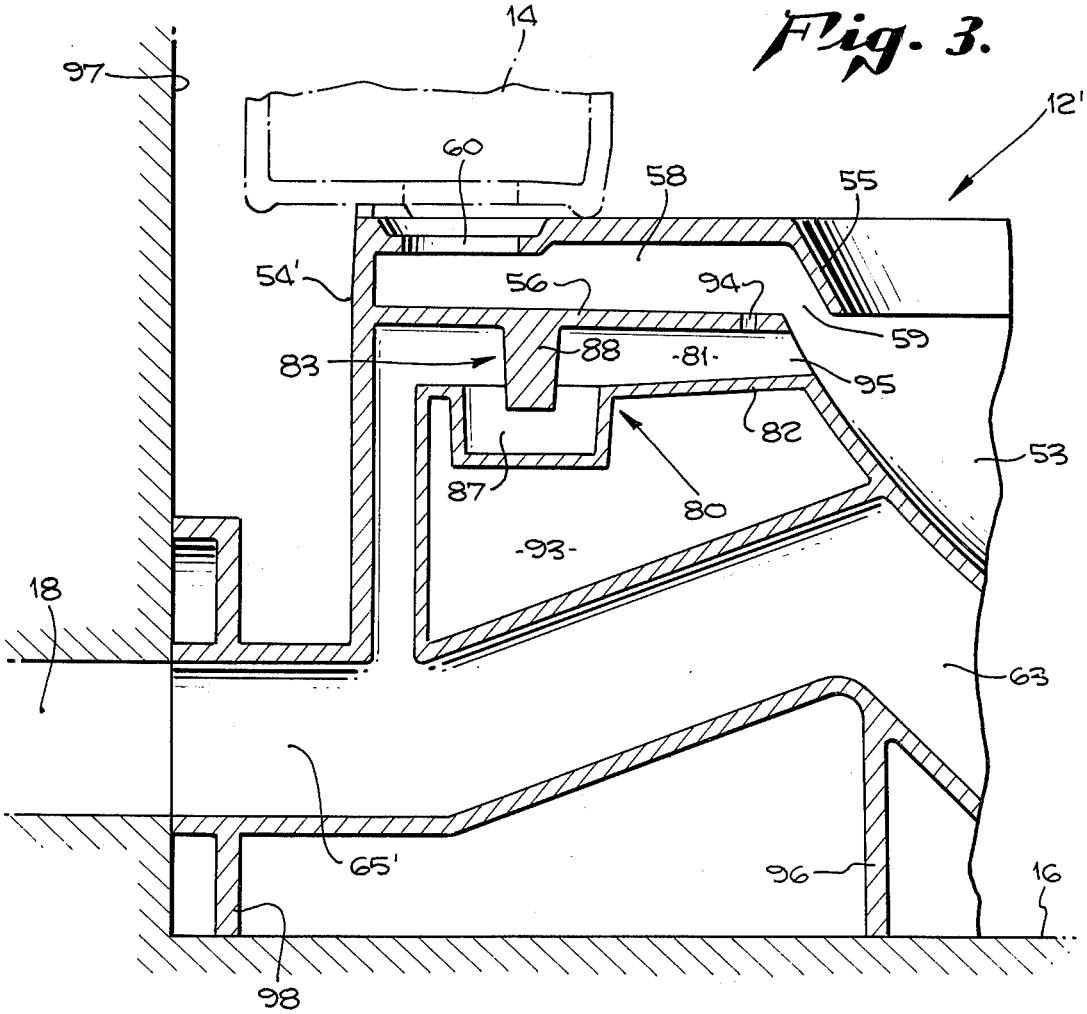
FIG. 3 is a cross-sectional view of a portion of a modified bowl similar to the bowl of FIG. 2.

In FIG. 3, a portion of a modified bowl 12' is shown having a discharge outlet 65' extending to the rear of bowl portion 53. Back wall 54' includes an opening therein through which outlet 65' extends, supported at the bottom by bracket 96 and against the wall 97 by a bracket 98. Since bowl 12' is otherwise identical to bowl 12 of FIG. 2 and like reference numerals refer to like parts of bowl 12 of FIG. 2, no further discussion is deemed necessary. Further, the operation of both bowls 12 and 12' is identical.

In operation, the toilet system 10 of FIG. 1 is to be understood as initially charged with a predetermined amount of an oil-based flushing fluid, a quantity of which may be stored in flushing fluid tank 14. When tank 14 is flushed, oil enters bowl 12 through manifold 50 onto bowl portion 53 washing down any waste therein in a quick, efficient manner. The waste and oil mixture flushes down through opening 62 and enters outlet 65 where it is discharged by gravity through waste pipe 18 into tank 22 of FIG. 1. The relatively large diameters of passageways 63, 65 assist in quickly and efficiently discharging the waste.

After flushing, a quantity of oil remains in bowl 12 rising to level 100 (level 100 extending from the upper portion of the merger of walls 64, 67 about the lower end of bowl portion 53 and end 61 to front wall 52). It can be seen in FIG. 2 that a trap seal X, which may be about 17/16 inch, is formed between level 100 and the bottom of end 61. This trap seal prevents any undesirable odors from passing up outlet 65 to the top of bowl 12.

Should bowl 12 clog during use with oil overflowing up the sides of bowl portion 53, such oil will enter overflow passageway 81 through opening 95 and flow, by gravity, through passageway 81 to passageway 89 and back into outlet 65. Oil will settle in trap 87 rising to level 101 which is coincident with the upper surface of wall 82. Thus, a trap seal, about ½ inch, will be formed in passagway 81 preventing any undesirable odors from outlet 65 backing up through passageways 89, 81 to bowl portion 53. The oil standing in trap 87 is constantly replenished after every flush by a small quantity entering aperture 94, which may be about ¼ inch in diameter.

It can be seen from the foregoing that we have described an improved oil toilet for quickly and efficiently flushing a large quantity of waste and oil and providing, as an integral part of the bowl or commode, for protection against overflow while sealing off any undesirable odors.

Any suitable dimensions may be used. For example, the cross-section of the interior of outlet 65 and trapway 63 may be about 3 inch in diameter with end 61 terminating about 17/16 inch below level 100. The opening 62 may be about 4 inch or so across and passageways 81 and 89 may be about ⅞ inch × 2 inch (if rectangular in cross-section). Trap seal may be about ½ inch with trap 87 about 1½inch × 3 in inner cross-section. Seal 88 may be about 1 inch × 1¾inch and hole or aperture 94 about ¼ inch in diameter. The radius of bowl portion 53 may be about 9 inch or so and peripheral wall 55 may be about 2 inch in height. Opening 59 may be about 11/16 inch across and opening 95, as discussed, may be about ½ inch × 2 inch in cross-section. Passageway 81 may slope gradually from 2 inch to 1⅛inch adjacent entry into trap 87. The portion of wall 55 extending below opening 59 may extend about ⅛ inch below the level of opening 59 and may be inclined at about 60° from the vertical.

Of course, any suitable dimensions, as discussed, may be used. Such suggested dimensions enables bowl 12 to be relatively light in weight, stable, and yet contain all the necessary integral components to be used as an oil toilet as discussed heretofore.

I claim:

1. In a recirculating toilet system having a bowl emptying into a waste tank having an oil-based flushing fluid of a specific gravity less than water in said tank, flushing fluid recirculating means associated with both said tank and said bowl for selectively removing flushing fluid from said tank and flushing said toilet therewith, the improvement which comprises:

said bowl being of the wash-down type, having a main bowl portion, a flushing manifold encircling at least a portion of the periphery of said bowl portion, a trapway in fluid communication with both the bottom of said bowl portion and a discharge outlet coupled to said waste tank, trap seal means associated with both said bowl portion and said trapway for sealing off odors from said waste tank entering back into said bowl portion, and overflow preventing means integral with said bowl portion in fluid communication with both the upper end of said bowl portion below said flushing manifold and said discharge outlet for removing any waste and oil backing up said bowl portion and returning the same to said discharge outlet, overflow preventing means including an overflow passageway communicating with said discharge outlet, and said trap seal means includes a trap in said passageway for receiving oil therein, and a seal extending transverse of the longitudinal axis of said passageway into said trap spaced above the bottom thereof and below the level of oil therein for providing a seal, said flushing manifold, including a generally horizontally extending passageway in fluid communication with said recirculating means, said first-mentioned passageway including a first portion extending generally parallel to said second-mentioned passageway and inclined downwardly from the horizontal, said first and second passageways being separated by a common wall, said trap being a chamber formed in the bottom wall of said passageway below said common wall, and said seal being an extension portion on said common wall extending down into said chamber.

2. In the system of claim 1 wherein said overflow preventing means includes trap seal means associated therewith for sealing off odors from said waste tank entering back into said bowl portion.

3. In the system of claim 1 further including oil replenishing means associated with both said manifold and said first-mentioned passageway for replenishing oil in said trap.

4. In the system of claim 3 wherein said oil replenishing means includes an aperture in fluid communication with both said manifold and said first-mentioned passageway, said aperture being located between said trap and said bowl portion.

5. In the system of claim 4 wherein said aperture extends through said common wall.

6. In the system of claim 4 wherein said aperture is a generally circular hole about ¼ inch in diameter and the upper level of said chamber is generally coincident with the upper level of the bottom wall of said first-mentioned passageway, said extension portion extending about ½ inch below said upper level of said chamber and being spaced generally equidistant from the walls forming said chamber.

7. In the system of claim 1 wherein flushing manifold includes a first generally horizontally exending wall, a second generally vertical wall integral with said horizontally extending wall merging into said bowl portion along a substantial portion thereof, and an inner peripheral wall spaced from said vertical wall, said inner peripheral wall being included toward the interior of said bowl portion and having its lower end terminating at a point slightly below an opening communicating said last-mentioned passageway with said bowl portion and being spaced from an opening communicating the first-mentioned passageway with said bowl portion.

8. A commode for use in a recirculating toilet system utilizing oil as a flushing fluid, said commode comprising:

a main bowl portion having an inner generally concave surface;

a generally horizontally extending flushing fluid manifold integral with the upper surface of said main bowl portion extending about the periphery thereof, said manifold being in fluid communication with incoming oil from said recirculating system and having an opening communicating with the upper surface of said bowl portion, said opening including a wall portion integral with said manifold inclined inwardly toward said concave surface;

a trapway integral with said bowl portion below said concave surface having a first concave portion below said concave surface and second oppositely concave portion integral with said first portion, said second concave portion being in fluid communication with a discharge outlet;

a trap seal in said outlet, said trap seal including an opening in said concave surface communicating with said trapway, said opening including a portion of the concave surface of said bowl portion extending down into said trapway spaced from the bottom thereof, said trap seal further including a trap formed by the bottom of the first concave portion and the upper level of approximately the intersection of said first and second concave portions, said portion of said concave surface extending below said upper level;

a first passageway at the upper surface of said bowl portion below said manifold extending generally parallel thereto and inclined downwardly from the horizontal opening at one end into said bowl portion and at the other end into a second passageway in fluid communication with said discharge outlet, said first passageway inclining downwardly toward said second passageway;

a trap formed in said first passageway including a chamber therein, said first passageway being downwardly inclined from said opening into said bowl portion to said trap; and a trap seal formed in said first passageway extending down into the interior of said chamber but spaced from the portion of said first passageway forming said chamber.

9. In the commode of claim 8 including an aperture in said first passageway communicating said manifold with said first passageway, said aperture being disposed between said trap and the opening in said first passageway communicating with said bowl portion.

10. In the commode of claim 8 wherein said trapway is about 3 inches in cross-section on the interior thereof, said portion of said concave surface extending about 17/16 inches below said upper level, said opening in said concave surface being about 4 inches across said last-mentioned opening, said concave surface having a radius of about 9 inches and said chamber in said first passageway being 3 inches in width and about 1½ inches in height with said seal extending about ½ inches down into said chamber below the upper level thereof.

11. In the commode of claim 8 wherein said second passageway extends generally transverse to said first passageway.

* * * * *